United States Patent [19]

Ebbinghaus et al.

[11] 4,331,377

[45] May 25, 1982

[54] TERMINAL, PREFERABLY FOR MOUNTING ON CIRCUIT BOARDS OF PRINTED CIRCUITS

[75] Inventors: Walter Ebbinghaus; Norbert Weisbrodt; Bernd Optenhövel, all of Hanau; Heinz Wennel, Bruchköbel, all of Fed. Rep. of Germany

[73] Assignee: Webster, Ebbinghaus & Co. (WECO), Hanau am Main, Fed. Rep. of Germany

[21] Appl. No.: 134,329

[22] Filed: Mar. 26, 1980

[30] Foreign Application Priority Data

Mar. 27, 1979 [DE] Fed. Rep. of Germany ..... 2911972

[51] Int. Cl.[3] ..... H01R 9/10

[52] U.S. Cl. ..... 339/272 A; 339/17 C

[58] Field of Search ..... 339/17 C, 198 R, 198 G, 339/266, 272

[56] References Cited

U.S. PATENT DOCUMENTS 3,848,958 11/1974 Kern ..... 339/272 A 4,171,152 10/1979 Geiseler ..... 339/272 A

FOREIGN PATENT DOCUMENTS 1230875 12/1966 Fed. Rep. of Germany ... 339/272 R 1915865 10/1970 Fed. Rep. of Germany ... 339/272 R

*Primary Examiner*—Joseph H. McGlynn

*Attorney, Agent, or Firm*—Dennison, Meserole, Pollack and Scheiner

[57] ABSTRACT

In a terminal, an insulating case with a terminal body detachably arranged in the case. The case includes a base surface adapted to parallel a circuit board upon a mounting of the terminal thereon. The terminal body has a beveled edge parallel to the base surface. A conductor socket extends into the terminal body through a surface remote from the beveled edge. The socket has an axis at an acute angle to the plane of the beveled edge. A retaining screw is threaded in the body and intersects the socket. A tab rigid with the beveled edge projects outwardly therefrom at an acute angle to the axis of the socket and through the base surface of the case.

14 Claims, 4 Drawing Figures

TERMINAL, PREFERABLY FOR MOUNTING ON CIRCUIT BOARDS OF PRINTED CIRCUITS

Figure 1:
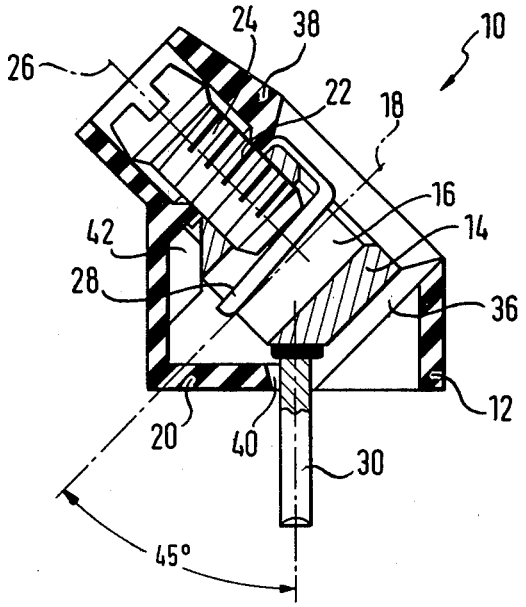

The invention relates to a terminal, preferably for mounting on circuit boards of printed circuits, essentially consisting of an insulating case of which the base surface, in assembled state, is running parallel to the circuit board, a terminal body detachably arranged in said case, as well as a tab vertically projecting outwards from the base surface, the axis of the tab being in plane or almost in plane with the screw axis and the conductor joint axis and at an angle of preferably 45° to the axis of the conductor joint.

Such a terminal for printed circuits is known from the German application No. 27 36 620. There the terminal body is formed like a block and the screw axis or, respectively, the axis of the conductor joint are at right angles to each other and at the same time vertically penetrate one surface each. In addition, the tab is configured as a part separated from the terminal body and connecting with the same. That means that as compared to the known 90° terminals where the tab is rigidly connected with the terminal body, a more expensive mounting is required in order to make the terminal ready for service. At the same time a bigger transition region between the tab and the terminal body must be provided in order to make a safe contact. Concerning the terminal pursuant to the German application No. 27 36 620, it is further necessary to bend the tab leaving the case, in order to obtain the desired angle of gradient between the axis of the conductor joint and the tab. For this purpose the opening of the insulating case is made bigger than the diameter of the tab. On the other hand, however, this means that due to the not positive connection between the terminal body and the tab, there exists an undesired space of motion for the projecting section of the tab, so that with multipole terminals it is not always guaranteed that the tabs can be mounted without any problems in the prepared holes of the circuit boards.

There is known a 45° terminal with a tab likewise detachably connected with the terminal body, however, being arranged force- or, respectively, form-lockingly in the insulating case. This means, however, that an increased energy consumption will be required for the assembly to carry out the putting together of the individual parts into the insulating case. Thereby, however, one could run the risk of a bending of the parts with respect to each other, so that the rejects can be relatively high.

It is, therefore, the object of the present invention to provide a terminal, preferably a 45° terminal of the kind mentioned at the outset, guaranteeing an easy assembly of the individual parts, requiring only little consumption of material, especially with respect to the tab, and guaranteeing, in addition, that the tab with regard to the base surface of the insulating case describes a desired fixed angle, so that the mounting in a circuit board can always take place without any difficulties.

Pursuant to the invention this object is achieved in that the terminal body has at least one beveled edge running parallel to the base surface and from which the tab is undetachably extending. Thereby in line with the novelty, the tab is preferably welded on. There is also the possibility of turning the tab on. In addition thereto, the surface of the beveled edges can be reduced at will then if the tab is folded on pursuant to an embodiment.

Preferably the terminal body has the form of a block.

By this solution according to the invention, there is provided for the first time a 45° terminal, of which only a total of two parts must be placed in an insulating case in order to obtain a ready mounted terminal: the terminal body with the rigidly connected tab, and the screw to fasten the conductor to be led in. By the simple mounting the cost of production is reduced, so that connecting elements can be offered at more favorable cost when compared to the known 45° terminals. According to the invention, the consumption of material for the tab is mainly determined by the length of the tab protruding outward from the base surface of the insulating case, which can have most different lengths as occasion may demand, whereas e.g. according to the German application No. 27 36 620, there will be a much larger consumption of material due to the fact that the tab is led within the insulating case in the range of the terminal body. Besides, a rather costly changing of tools is required for different lengths of tabs.

In order that the terminal body cannot be displaced within the insulating case, guide surfaces or webs or shoulders running parallel to each other are arranged in the insulating case, of which the distance is corresponding to the distance of the surface of the terminal body running parallel to the axis of the conductor joint and being penetrated by the screw axis, and which guide means pass into the opening of the insulating case for inserting the terminal body. By these guide surfaces or, respectively, webs or shoulders, and together with the screw penetrating the case for clamping a conductor, it is guaranteed that an unintentional tilting or twisting of the terminal body does not take place, so that the tab will always leave the base surface of the insulating case at the desired angle. Now in order to realize a simple mounting of the terminal body in the insulating case with the dimensions as suggested according to the invention of the guide surfaces or, respectively, webs or shoulders in regard to the dimensions of the terminal body, a second beveled edge is preferably provided on the terminal body, of which the normal is running vertically or almost vertically to the normal of the first beveled edge, being in plane with the latter and facing the backwall of the insulating case preferably running vertically to the base surface. In other words, the second beveled edge runs parallel to the backwall and is facing the same. That means that when starting to insert the terminal body in the insulating case through the opening, the opposite distances of the terminal body are smaller than those of the guide surfaces or webs or shoulders. This permits a tilting and turning in the beginning, so that the tab can be inserted without any difficulties through appropriate openings as e.g. holes or slits in the base surface of the insulating case.

As the base surface is preferably running vertically to the backwall of the insulating case, there is a distance between the backwall and that surface of the terminal body facing the latter due to the block-shaped configuration of the terminal body. In order to support and thus additonally lock the terminal body within the insulating case, a shoulder is preferably provided in the area of the backwall, against which the mounted terminal body is resting with its second beveled edge.

Figure 3:
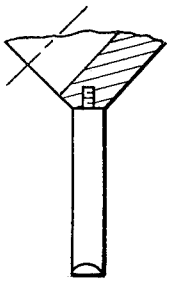
Figure 4:
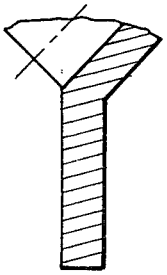

Further details, advantages and characteristics of the invention will result from the following description of the drawings. It is shown in FIG. 1 a 45° terminal according to the invention in an insulating case, FIG. 2 a terminal body with tab according to FIG. 1, and FIGS. 3 and 4 terminal bodys with the tabs respectively threadedly attached and folded on.

FIG. 1 is a sectional view of the side elevation of a 45° terminal according to the invention. The same consists of an insulating case 12 into which a terminal body 14 is mounted. The terminal body 14 has preferably the form of a block. In order to insert a conductor in the terminal body 14, a recess 16 is provided of which the center line 18, which can be designated as axis of the conductor joint, is describing an angle of 45° to the base surface 20 of the insulting case 12. so that consequently the conductor forms the desired angle with respect to a circuit board, on which the terminal 10 according to the invention has been mounted with its base surface. In the embodiment example according to FIG. 1, the recess 16 for the conductor is shown as a piercing boring. A tapped hole 22 is running vertically to the axis of the conductor joint 18, into which a screw 24 can be placed to fasten the conductor within the recess 16. The axis of the boring 22 is designated as screw axis and has the reference number 26.

Further in FIG. 1 there is shown a wire shield 28 for preventing a direct contact of the screw 24 with the conductor to be clamped in, in order to exclude any undesired deformation.

The base surface 20 of the insulating case 12 is penetrated by a tab 30, that can be inserted in openings of a circuit board. As the tab 30 describes a right angle to the base surface 20, the angle existing between circuit board and conductor will not be changed when the tab 30 is inserted in the openings of the circuit board.

Figure 2:
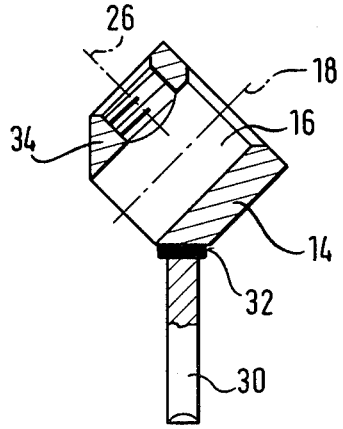

FIG. 2 shows the terminal body 14 with the tab 30 separately from the remaining parts of the terminal 10. According to the invention, the terminal body 14 has a beveled edge 32, to which the tab is fastened, preferably by welding, turning or folding as respectively illustrated in FIGS. 2, 3 and 4;. This will offer the advantage that the terminal body 14 with the tab 30 as a unit can be mounted in the insulating case 12. Further it can be learned from FIG. 2 as well as from FIG. 1 that another beveled edge 34 is provided on the terminal body 14. According to the invention the edge surfaces 32 and 34 are configured in such a manner that their extensions preferably form a right angle. The second beveled edge 34 offers the advantage that the terminal body 14 with the tab 30 can be inserted in the insulating case without any difficulty, although the distance of the guide webs 36 or, respectively, guide surfaces 38 equals the distance of the surfaces being penetrated by the screw axis 26. In other words, the distance between the webs 36, 38 or, respectively, the corresponding surfaces is selected in such a manner that no undesired tilting or displacing can take place after inserting of the terminal body 14, if at the same time the screw 24 has been screwed in. The other beveled edge 34 permits that at the beginning of the mounting, the tab 30 can be inserted in a recess 40 in the base surface 20 of the insulating case 12, in order to thereafter obtain the desired position within the insulating case by a tilting of the terminal body. This beveled edge 34 ultimately rests against shoulder 42 within the insulating case.

We claim:

1. A terminal, preferably for mounting on circuit boards of printed circuits, comprising an insulating case and a terminal body detachably arranged in said insulating case, said case having a base surface adapted to parallel a circuit board upon a mounting of the terminal thereon, said terminal body having a beveled edge parallel to said base surface, a conductor socket extending into said terminal body through a surface remote from said beveled edge, said socket having an axis at an acute angle to the plane of the beveled edge, a retaining screw threaded in said body and intersecting said socket, and a tab rigid with said beveled edge and projecting outwardly therefrom at an acute angle to the axis of the socket and through said base surface of the case.

2. A terminal in accordance with claim 1 wherein each of said acute angles is substantially 45°.

3. A terminal in accordance with claim 2 wherein said retaining screw has an axis forming an intersection with the socket axis, said tab being in a substantially common plane with the intersection of the screw axis and the socket axis.

4. A terminal in accordance with claim 3 wherein said insulating case includes an interior chamber for receiving the terminal body, said chamber opening outward to receive said terminal body therein, and inner guide surfaces within said chamber engaging and positioning said terminal body with the beveled edge of the terminal body overlying and paralleling the base surface of the case.

5. A terminal in accordance with claim 4 wherein said terminal body includes outer guide surfaces thereon parallel to the axis of the conductor socket to the opposite sides thereof, said outer guide surfaces being engaged by the inner guide surfaces of the case.

6. A terminal in accordance with claim 5 wherein a first one of said outer guide surfaces extends from said beveled edge to the body surface through which the conductor socket extends.

7. A terminal in accordance with claim 6 wherein said retaining screw is accessible from the exterior of the case for manipulation of said screw.

8. A terminal in accordance with claim 7 wherein said terminal body has a second beveled edge normal to the first beveled edge and defined at an edge of the second outer guide surface, the chamber of the insulating case including an interior back wall substantially vertical to the base surface, spacing means projecting inwardly of said chamber from the back wall, the second beveled edge of the terminal body engaging against said spacing means.

9. A terminal in accordance with claims 1 or 7 wherein said tab is welded to said beveled edge.

10. A terminal in accordance with claims 1 or 7 wherein said tab is threadedly attached to said beveled edge.

11. A terminal in accordance with claims 1 or 7 wherein said tab is folded on said beveled edge.

12. In a terminal, preferably for mounting on circuit boards of printed circuits, a terminal body, said terminal body having a beveled edge adapted to a parallel the circuit board, a conductor socket extending into said terminal body through a surface remote from said beveled edge, said socket having an axis at an acute angle to the plane of the beveled edge, a retaining screw threaded in said body and intersecting said socket, and a tab rigid with said beveled edge and projecting outwardly therefrom at an acute angle to the axis of the socket.

13. A terminal in accordance with claim 12 wherein each of said acute angles is substantially 45°.

14. A terminal in accordance with claim 13 wherein said retaining screw has an axis forming an intersection with the socket axis, said tab being in a substantially common place with the intersection of the screw axis and the socket axis.

* * * * *